US006494743B1

(12) United States Patent
Lamatsch et al.

(10) Patent No.: US 6,494,743 B1
(45) **Date of Patent: *Dec. 17, 2002**

(54) IMPEDANCE-CONTROLLED CONNECTOR

(75) Inventors: Michael J. Lamatsch, Roseville, MN (US); Gerard A. Drewek, Rosemount, MN (US)

(73) Assignee: General Dynamics Information Systems, Inc., Bloomington, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/607,487

(22) Filed: Jun. 30, 2000

Related U.S. Application Data

(60) Provisional application No. 60/142,337, filed on Jul. 2, 1999.

(51) Int. Cl.[7] ..... H01R 13/648; H01R 13/502; H01R 13/514

(52) U.S. Cl. ..... 439/608; 439/701

(58) Field of Search ..... 439/607–610, 439/108, 33, 34, 260, 541.5, 701, 502; 385/55, 56

(56) References Cited

U.S. PATENT DOCUMENTS

| | | | | | |
|---|---|---|---|---|---|
| 4,596,435 | A | | 6/1986 | Bickford | 339/177 R |
| 4,836,791 | A | * | 6/1989 | Grabbe | 439/79 |
| 4,902,092 | A | * | 2/1990 | Grandy | 385/56 |
| 5,151,036 | A | * | 9/1992 | Fusselman et al. | 439/108 |
| 5,352,133 | A | * | 10/1994 | Sampson | 439/350 |
| 5,401,173 | A | | 3/1995 | Grandchamp et al. | 439/33 |
| 5,404,117 | A | | 4/1995 | Walz | 333/34 |
| 5,415,566 | A | | 5/1995 | Brunker et al. | 439/608 |
| 5,817,973 | A | | 10/1998 | Elco | 174/32 |
| 5,980,321 | A | | 11/1999 | Cohen et al. | 439/608 |
| 5,993,259 | A | | 11/1999 | Stokoe et al. | 439/608 |
| 6,016,086 | A | | 1/2000 | Williamson et al. | 333/109 |
| 6,102,747 | A | * | 8/2000 | Paagman | 439/701 |
| 6,168,462 | B1 | * | 1/2001 | Liao | 439/541.5 |
| 6,183,292 | B1 | * | 2/2001 | Chen et al. | 439/541.5 |

FOREIGN PATENT DOCUMENTS

| | | |
|---|---|---|
| EP | 394205 B1 | 3/1990 |
| EP | 537444 B1 | 8/1992 |
| JP | 3165473 | 7/1991 |
| JP | 5275139 | 10/1993 |
| JP | 9802025 | 1/1998 |
| JP | 11162265 | 6/1999 |

* cited by examiner

*Primary Examiner*—Khiem Nguyen
*Assistant Examiner*—Chandrika Prasad
(74) *Attorney, Agent, or Firm*—Jenner & Block, LLC

(57) ABSTRACT

An electrical connector assembly using conventional signal pins is adapted for use with impedance-controlled cables by dividing the body of the connector into one or more separate channels. Each channel is defined by a perimeter providing electrical shielding. A separate impedance-controlled wire or cable can be terminated at conventional signal pins installed in an insert located within a particular channel. A transition region between a connector plug or receptacle and an incoming wire or cable preserves the correct impedance characteristics of the cable.

18 Claims, 5 Drawing Sheets

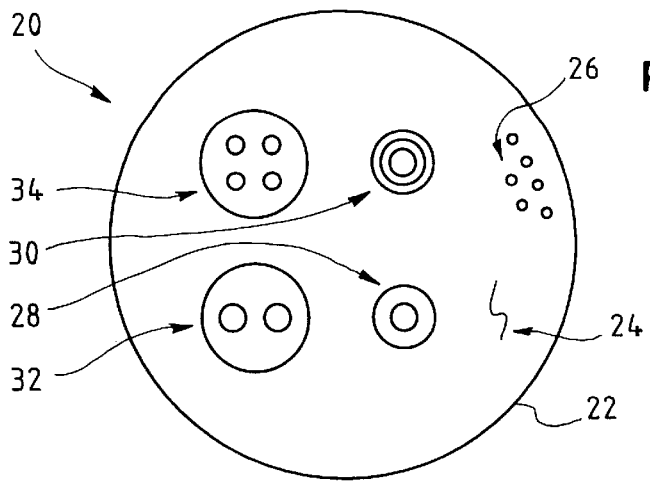
FIG. 1
PRIOR ART
FIG. 2A
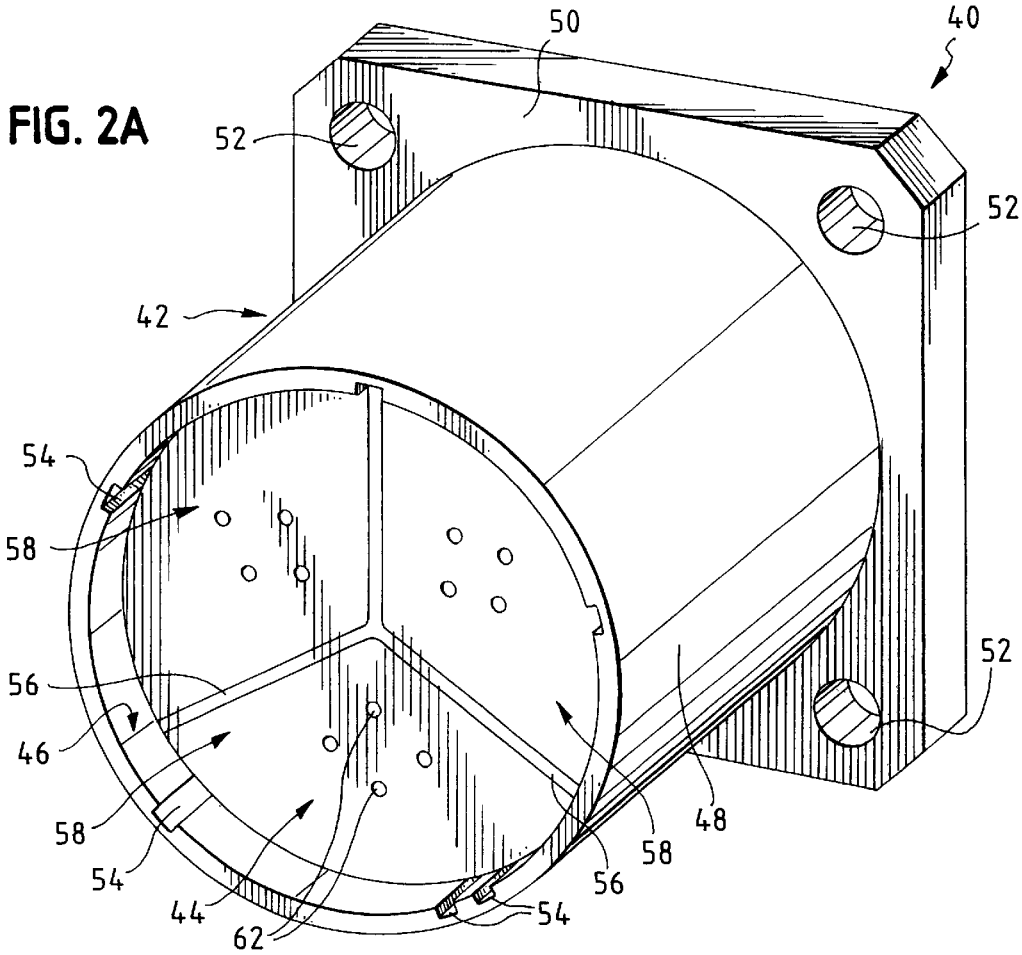

IMPEDANCE-CONTROLLED CONNECTOR

CROSS REFERENCE TO RELATED APPLICATION

This application claims the benefit of United States Provisional Patent Application No. 60/142,337 filed on Jul. 2, 1999 by Michael J. Lamatsch.

BACKGROUND OF THE INVENTION

1. The Technical Field

The invention relates generally to electrical connectors. More particularly, the invention relates to electrical connectors adapted for connecting impedance-controlled wires and cables.

2. The Prior Art

Impedance-controlled electrical connectors for connecting impedance-controlled wire and cable are known in the art. Special families of impedance-controlled connectors, such as Triax, SMA, BNC, N, MHV, and others, have been developed for this purpose. Typically, such connectors are used for connecting multi-axial cable, although such connectors also can be used for connecting other types of impedance-controlled wire and cable, including, for example, shielded wire pairs and quads.

Also, some general purpose connectors, such as those according to Military Specification MIL-38999, have been adapted for connecting impedance-controlled wires and cables. Such general purpose connectors having conventional connector pins typically are used for connecting wiring and cable that does not have stringent impedance control requirements. Notwithstanding, custom inserts have been developed to allow impedance-controlled wire and cable to be connected using such a general purpose connector.

An example of a prior art general purpose connector having such special inserts is illustrated in FIG. 1. Prior art connector 20 comprises a connector shell 22 having a conventional insert 24 comprising a conventional dielectric material. Various conducting elements penetrate the dielectric material 24, including conventional connector pins 26, a custom coaxial cable insert 28, a custom triaxial cable insert 30, a custom paired wire insert 32, and a custom quad wire insert 34. Each of custom inserts 28, 30, 32, and 34 is specially made for use in connection with connector 20. Such custom inserts typically are made using special dielectric material and they typically include special ground shields. As such, these custom inserts are costly to fabricate and to integrate with a conventional, general purpose connector.

It would be desirable to provide an electrical connector for use in connecting impedance-controlled wires and cables which uses conventional, low-cost materials and fabricating techniques.

SUMMARY OF THE INVENTION

The present invention is directed to an electrical connector assembly, preferably comprising a plug and a receptacle, for connecting impedance-controlled wires and cables, as well as wires and cables not having strict impedance control requirements. In a preferred embodiment, each of the plug and receptacle comprises an annular shell which is open at each end and which defines an interior region and an inner and outer surface. Preferably, the shell is cylindrical, having a circular cross section. In alternative embodiments, the shell can have other cross sections, such as oval, rectangular, pentagonal, etc. A divider extending axially through the interior region of the shell divides the interior region of the shell into two or more channels. Both the shell and the divider are made of a material which provides electrical shielding and the necessary structural characteristics. Any number of metals would be suitable for this application, as would be known to one skilled in the art. The shell and divider can be fabricated monolithically, e.g., cast as a single piece or machined from a solid block of material. Alternatively, the shell and divider can fabricated as separate components and subsequently welded, keyed, press-fit, bonded, or otherwise joined together.

Preferably, each of the channels defined by the shell and divider contains an insert made of a conventional or other dielectric material, although one or more of such channels can be hollow. The insert preferably is shaped to conform to the shape of the channel, and preferably is securely positioned within the channel. Preferably, one or more conductors penetrate each such insert, although one or more of such inserts can lack conductors. One end of each such conductor preferably is configured to be terminated to a conductor of a wire or cable feeding into the connector, as would be known to one skilled in the art. The other end of the conductor preferably is configured as a pin or a pin receptacle for mating with a corresponding receptacle or pin, respectively, as would be known to one skilled in the art. Corresponding pairs of connector plugs and receptacles can be keyed to ensure proper alignment of corresponding dividers, pins, and pin receptacles when a connector plug is connected to a corresponding connector receptacle.

BRIEF DESCRIPTION OF THE DRAWINGS

FIG. 1 is an end view of a prior art general purpose connector adapted for use with impedance-controlled and conventional wires and cables;

FIG. 2A is an isometric view of a preferred embodiment of an impedance-controlled connector receptacle according to the present invention;

DESCRIPTION OF THE PREFERRED EMBODIMENT

Figure 2B:
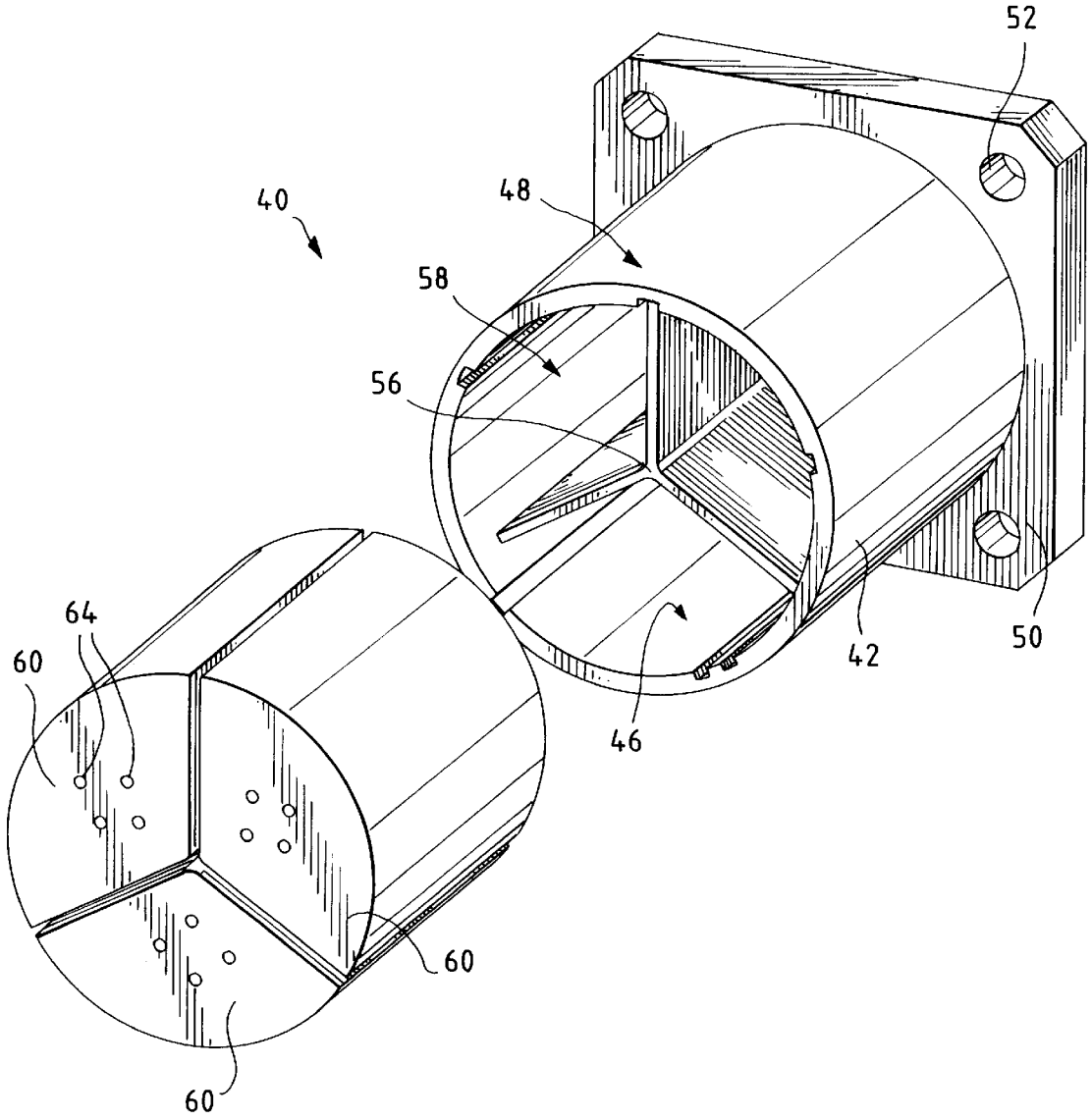
FIG. 2B is an exploded isometric view of a preferred embodiment of an impedance-controlled connector receptacle according to the present invention.
Figure 4:
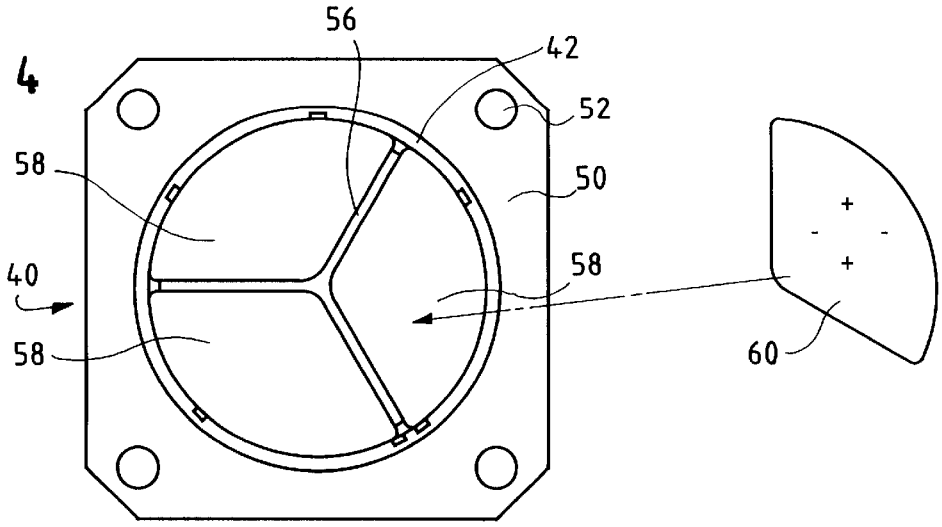
FIG. 4 is a front elevation view of a preferred embodiment of an impedance-controlled connector receptacle according to the present invention.

FIGS. 2A, 2B, and 4 illustrate a preferred embodiment of an impedance-controlled electrical connector receptacle 40 according to the present invention. Receptacle 40 comprises an annular shell 42 which is open at both ends, thus defining an interior region 44, an inner surface 46, and an outer surface 48. Preferably, shell 42 is cylindrical, having a circular cross section. However, in other embodiments, shell 42 can have an oval, rectangular, or other cross section.

In the embodiments shown in FIGS. 2A–2B and FIGS. 4–6, a mounting plate 50 having a number of through holes 52 is attached to outer surface 48 of shell 42. Mounting plate 50 can be used in connection with screws or other fasteners (not shown) to secure shell 42 to an electrical equipment panel or other surface (not shown). In alternative embodiments, mounting plate 50 can take other forms, can be attached to receptacle 40 in other ways, or can be omitted.

Inner surface 46 of shell 42 can include one or more keyways 54 formed therein. Keyways 54 extend axially from the open end of shell 42 along at least a portion of the length of shell 42. Keyways 54 are configured to accept keys located on a corresponding connector plug, as will be described further herein.

Figure 5:
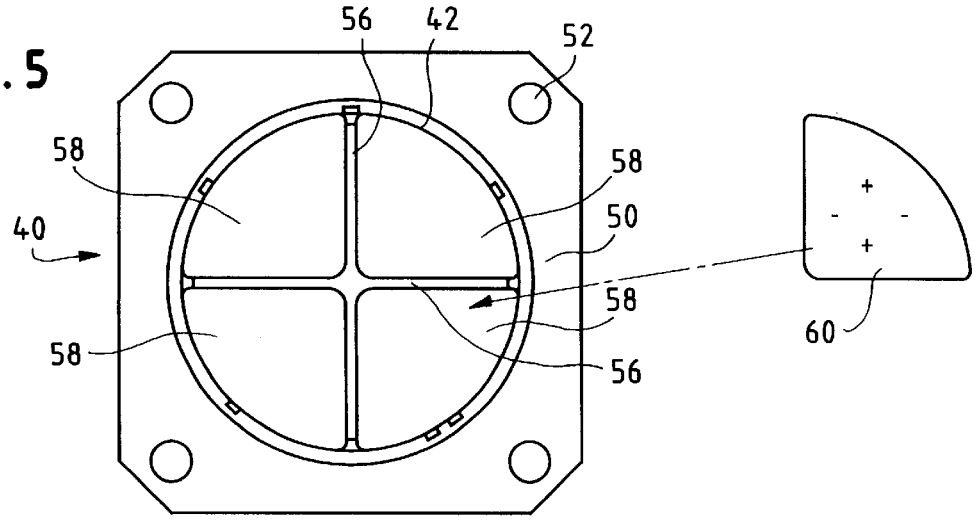
FIG. 5 is a front elevation view of an alternate embodiment of an impedance-controlled connector receptacle according to the present invention.
Figure 6:
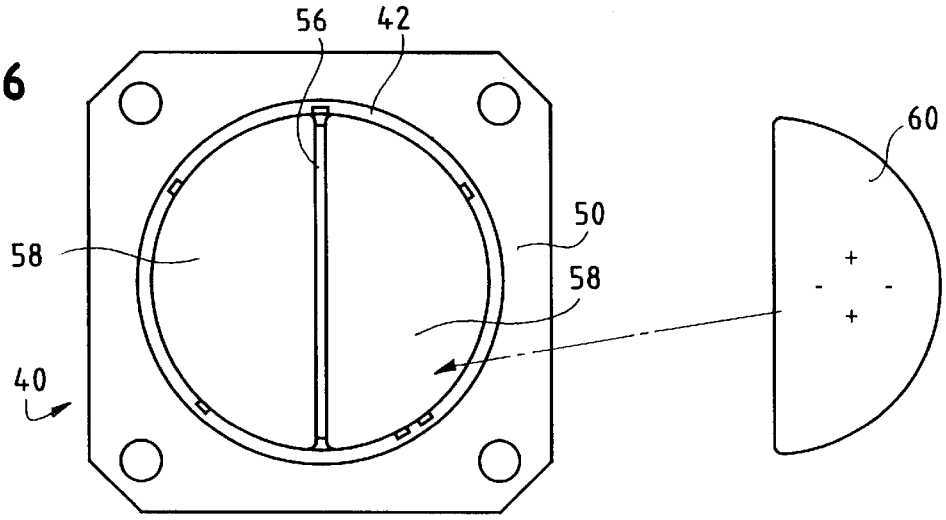
FIG. 6 is a front elevation view of another alternate embodiment of an impedance-controlled connector receptacle according to the present invention.

A divider 56 is disposed within shell 42, dividing interior region 44 of shell 42 into separate and distinct channels 58. In the embodiment illustrated in FIGS. 2 and 4, divider 56 is Y-shaped and it divides interior region 44 of shell 42 into three channels 58. In other embodiments, divider 56 can be configured to divide interior region 44 of shell 42 into more or fewer than three channels. For example, FIGS. 5 and 6 illustrate a connector receptacle 40 having an interior region divided into four and two channels, respectively.

Each of shell 42 and divider 56 preferably is made of aluminum or any other suitable material having electrical shielding characteristics. Therefore, each of such channels 58 serves to shield conductors passing therethrough, as will be discussed further below.

Shell 42 and divider 56 can be fabricated monolithically or separately. For example, shell 42 and divider 56 can be cast as a single element, or shell 42 and divider 56 can be machined from a single block of material. Alternatively, shell 42 and divider 56 can be fabricated as separate pieces and then joined in any suitable manner, such as by welding, bonding, and interference-fit, among others.

In a preferred embodiment, an insert 60 made of dielectric material is securely positioned within each channel 58 defined by shell 42 and divider 56. In alternative embodiments, one or more channels 58 can remain hollow. Each insert 60 is shaped to conform to the channel 58 in which such insert is located.

Each insert 60 preferably includes one or more conductors 62 which penetrate insert 60. One end of each such conductor 62 preferably is configured as a pin receptacle 64 which can be mated with a corresponding pin, as would be known to one skilled in the art. The other end of each conductor 62 preferably is configured for electrical termination to an external wire or cable (not shown).

Divider 56 preferably extends substantially through the length of shell 42, although it need not extend through the entire length of shell 42. Accordingly, each of channels 58 extends substantially through the length of shell 42, although not necessarily through the entire length of shell 42. Each insert 60 preferably extends through a substantial length of its corresponding channel 58, but preferably not through the entire length of the channel. That is, some portion of each channel 58 preferably remains hollow to provide adequate space to house the deshielded portion of wire or cable 66 terminated at one or more conductors 62 therein.

Figure 3:
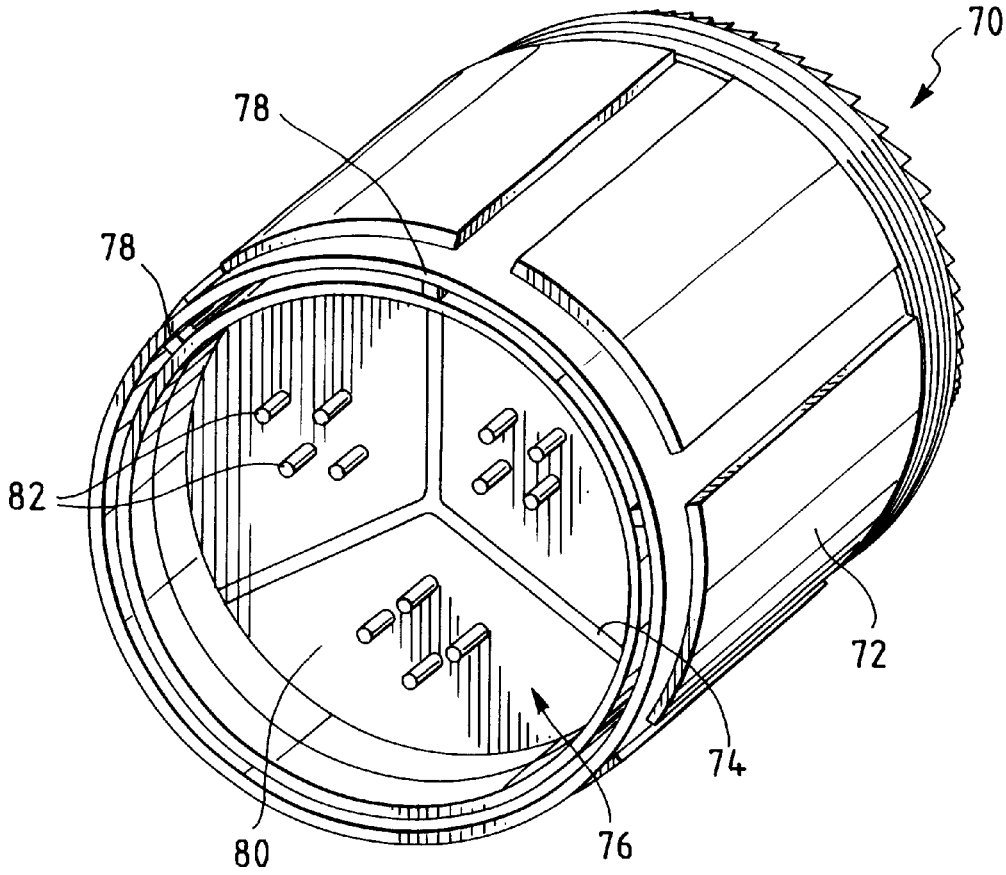
FIG. 3 is an isometric view of a preferred embodiment of an impedance-controlled connector plug according to the present invention.

FIG. 3 illustrates a preferred embodiment of an impedance-controlled electrical connector plug 70 which is configured to mate with a corresponding connector receptacle 40. The construction of plug 70 is similar to the construction of receptacle 40 described above. That is, plug 70 comprises a shell 72 having a shape similar to that of shell 42 of receptacle 40 and a divider 74 having a configuration similar to that of divider 56 of receptacle 40. Shell 72 and divider 74 define a number of channels 76 which correspond to channels 58 in a mating receptacle 40. Receptacle shell 42 and plug shell 72 are sized and configured to facilitate connection of plug 70 to receptacle 40, as would be known to one skilled in the art.

Preferably, each channel 76 in plug 70 includes an insert 80 similar in design and construction to a corresponding insert 60 in a corresponding receptacle 40. Each such insert 80 preferably includes a number of conductors 82 configured or oriented in a manner corresponding to the configuration or orientation of conductors 62 in a corresponding insert 60 of a corresponding receptacle 40. One end of each of such conductors 82 preferably is configured for electrical termination to an external wire or cable, such as cable 86 illustrated in FIG. 7. The other end of each of such conductors preferably is configured as a pin 84 which can be mated with a corresponding pin receptacle, such as pin receptacle 64 of receptacle 40.

Shell 72 preferably includes one or more keys 78 which correspond with keyways 54 in a corresponding receptacle 40. Preferably, keys 78 and keyways 54 are configured so that when plug 70 is mated with corresponding receptacle 40, channels 76 of plug 70 necessarily align with channels 58 of receptacle 40 and pins 84 of plug 70 necessarily align with pin receptacles 64 of receptacle 40.

Plug 70 and receptacle 40 can be provided with any variety of conventional mechanism for securing the connected plug and receptacle together. For example, plug 70 can be provided with an internally threaded collar (not shown) and the outer surface 48 of shell 42 of receptacle 40 can be provided with mating threads, so that the collar of plug 70 can be tightened onto receptacle 40, thereby securing plug 70 to receptacle 40.

Figure 7:
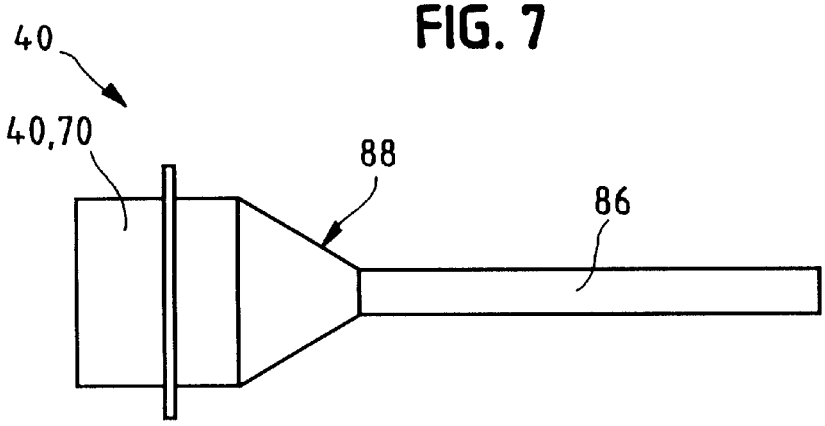
FIG. 7 is a side elevation view of an impedance-controlled cable terminated at an impedance-controlled connector according to the present invention.

An impedance-controlled wire, such as cable 86 illustrated in FIG. 7, can be terminated to an impedance-controlled connector receptacle 40 or plug 70 by removing preferably only the minimum amount of shielding and/or insulation from the end of the wire necessary to permit electrical termination of the wire and then terminating the wire to a conductor 62, 82 of receptacle 40 or plug 70 in a conventional manner, as would be known to one skilled in the art. In order to maintain the impedance control characteristics of the wire and the connector, the entire portion of the wire from which the shielding was removed should be contained within the channel housing the conductor 62, 82 to which the wire was terminated.

An impedance controlled cable, such as cable 86 illustrated in FIG. 7 can be terminated to an impedance-controlled connector receptacle 40 or plug 70 by first removing a minimal amount of shielding from the cable so as to expose the individual conductors, removing the insulation from the individual cable conductors, and then terminating the individual cable conductors to certain conductors 62, 82 of receptacle 40 or plug 70 in a conventional manner, as would be known to one skilled in the art.

Correct impedance through the connector is maintained by careful design and selection of the geometric locations of the conductor pins 84 and pin receptacles 64 used in connection with the specific conductors of an impedance-controlled cable 86, as would be known by one skilled in the art, and by use of a transition region 88 between cable 86 and connector receptacle 40 or connector plug 70. The geometric locations of the conductor pins 84 and pin receptacles 64 can be determined using a commercially available computer program, such as the SPICE program marketed by Ansoft Corporation of Pittsburgh, Pa. or similar commercial or proprietary program.

Figure 8:
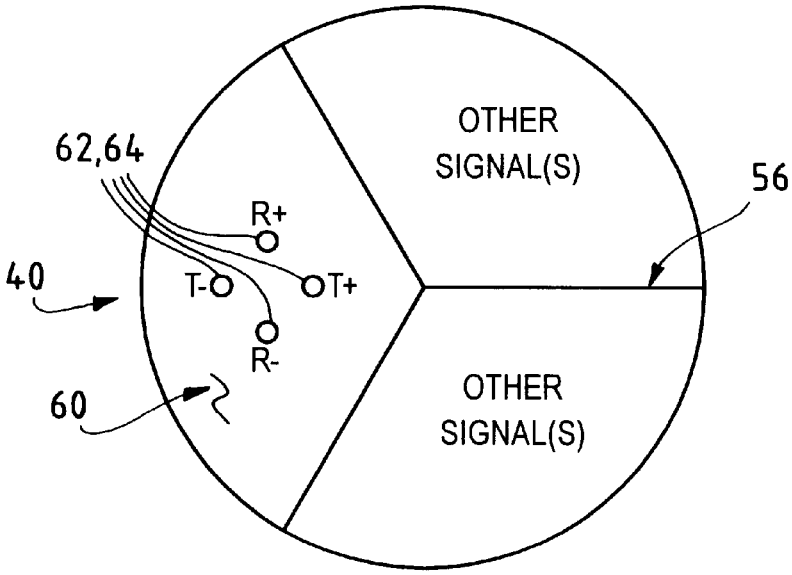
FIG. 8 is a schematic view of a preferred pin configuration in a connector according to the present invention.

For example, FIG. 8 depicts a preferred embodiment of a connector receptacle 40 having an insert 60 configured for use with a four conductor cable (not shown). Insert 60 includes four conductors 62 and the associated pin receptacles 64. Preferably, the conductors of the four conductor cable (not shown) are terminated to conductors 62 so that a pair of transmit signals T+ and T− are located orthogonally between a pair of receive signals R+ and R−. In other embodiments, other pin selections are possible. The desired pin selection can vary depending on the type of incoming cable 86 to be terminated at the connector receptacle 40 or plug 70 and the electrical properties of the dielectric used for insert 60, 80, among other characteristics of the particular embodiment.

A connector receptacle 40 and/or plug 70 according to the present invention also can be used with wires and cables not having strict impedance control requirements, either alone or in combination with impedance-controlled wires and cables. Preferably, each separate impedance-controlled wire or cable terminated at a connector plug 70 or receptacle 40 is terminated at a separate insert 60, 80 within a corresponding separate channel 58, 76.

The embodiments described herein are merely illustrative, and are not intended to limit the scope of the invention. It will be apparent to those skilled in the art that various modifications, additions, substitutions, and the like can be made without departing from the spirit of the invention as defined by the following claims.

We claim:

1. An impedance-controlled electrical connector assembly, comprising:

a first shell portion having a first interior region, a first open end, a second open end, an inner wall, and an outer wall;

a second shell portion having a second interior region;

said first shell portion having a first divider disposed therein, said first divider dividing said first interior region into a first plurality of channels;

said second shell portion having a second divider disposed therein, said second divider dividing said second interior region into a second plurality of channels;

one or more conductors penetrating one or more of said channels; a dielectric material disposed within one or more of said channels, said dielectric material substantially filling the gaps between said conductors and the perimeter of said channels;

wherein said first shell portion is selectively attachable to said second shell portion such that when said first shell portion is attached to said second shell portion, each of said first plurality of conductors makes electrical contact with a corresponding one of said second plurality of electrical conductors.

2. The apparatus of claim 1 wherein said first divider comprises at least one web which is connected to said inner wall of said first shell portion.

3. The apparatus of claim 1 wherein said first divider extends substantially from said first open end of said first shell portion to said second open end of said first shell portion.

4. The apparatus of claim 1 wherein said first shell portion and said first divider are made of a material having electrical shielding characteristics.

5. The apparatus of claim 4 wherein said material is metal.

6. The apparatus of claim 4 wherein said material is aluminum.

7. The apparatus of claim 1 further comprising a mounting plate attached to said outer wall of said first shell portion.

8. The apparatus of claim 1 wherein said first divider is integrally attached to said first shell portion.

9. The apparatus of claim 1 wherein said first divider is monolithically formed with said first shell portion.

10. The apparatus of claim 1 wherein said first end of said conductor is a pin configured for engagement with a receptacle.

11. The apparatus of claim 1 wherein said first end of said conductor is a receptacle configured for engagement with a pin.

12. The apparatus of claim 1 wherein said dielectric is plastic.

13. The apparatus of claim 1 further including a keyway associated with said first shell portion.

14. The apparatus of claim 1 further including a key associated with said first shell portion.

15. The apparatus of claim 1 wherein said second end of said conductor is configured for electrical termination with a wire.

16. The apparatus of claim 1 further comprising a transition region proximate said second open end of said first shell portion.

17. The apparatus of claim 1 further comprising means for selectively securing said first shell portion to said second shell portion.

18. A method for controlling impedance through a connector, comprising the steps of:

providing a first shell portion having a first interior region defined by a first continuous side wall, said first shell portion having a first divider disposed therein, said divider dividing said first interior region into a first plurality of channels;

providing a second shell portion having a second interior region defined by a second continuous side wall, said second shell portion having a second divider disposed therein, said second divider dividing said second interior region into a second plurality of channels;

orienting a first conductor having a predetermined size within one of said first plurality of channels in a predetermined manner;

orienting a corresponding second conductor having a predetermined size within a corresponding one of said second plurality of channels in a predetermined manner; and disposing a dielectric material having predetermined electrical properties within said one of said first plurality of channels and said one of said second plurality of channels, such that said dielectric material substantially fills the gaps between said first and second conductors and the perimeter of said ones of said first and second pluralities of channels, respectively;

wherein said predetermined sizing, said predetermined orientation, and said predetermined electrical properties are selected to maintain the impedance characteristic of said conductors through said first and said second connector shells; and wherein said first shell portion is selectively attachable to said second shell portion such that when said first shell portion is attached to said second shell portion, said first conductor makes electrical contact with said second conductor.

* * * * *